US005951101A

United States Patent [19]

Chen

[11] Patent Number: 5,951,101

[45] Date of Patent: Sep. 14, 1999

[54] COLLAPSIBLE TOWER

[76] Inventor: Wei L. Chen, One Lake Vista Way, Ormond Beach, Fla. 32174

[21] Appl. No.: 09/164,505

[22] Filed: Sep. 30, 1998

[51] Int. Cl.[6] ..... A47C 4/00

[52] U.S. Cl. ..... 297/16.1; 297/59

[58] Field of Search ..... 297/16.1, 16.2, 297/59, 60

[56] References Cited

U.S. PATENT DOCUMENTS

| | | | |
|---|---|---|---|
| 3,123,395 | 3/1964 | Glass | 297/16.1 |
| 4,278,287 | 7/1981 | Homestead | 297/59 |
| 4,440,264 | 4/1984 | Knoke et al. | 297/59 X |
| 4,846,486 | 7/1989 | Hobson | 297/60 X |
| 4,889,383 | 12/1989 | Jones | 297/16.1 |

FOREIGN PATENT DOCUMENTS

| | | | |
|---|---|---|---|
| 1220346 | 1/1971 | United Kingdom | 297/16.1 |

*Primary Examiner*—Laurie K. Cranmer

[57] ABSTRACT

A collapsible tower including a pair of similarly configured side frame assemblies Each side frame assembly includes a horizontal lower front tube having a front end and a rear end The rear end of the horizontal lower front tube is upwardly turned to have a short vertical extent. A long vertical back tube has an upper end and a lower end with the upper end of the long vertical back tube including a short forwardly extending horizontal extent. A short vertical front tube has an upper end and a lower end. A diagonal tube has a lower end and an upper end. A long horizontal intermediate tube is provided with the rear end of the long horizontal intermediate tube being securely coupled to the intermediate extent of the long vertical back tube. A short horizontal intermediate tube is included. A cross tube couples the side frame assemblies. A plurality of hinges couples the plurality of tubes including a triple hinge located adjacent to the lower end of the diagonal tube. At least one resilient clip is provided to releasably receive the triple hinge.

4 Claims, 4 Drawing Sheets

FIG 7
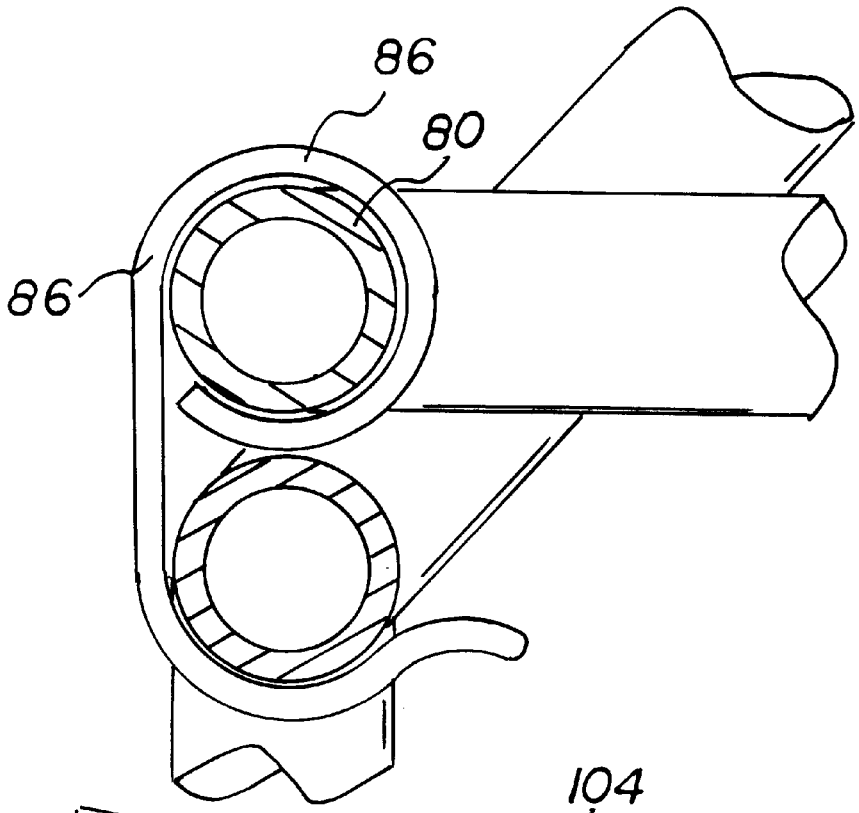
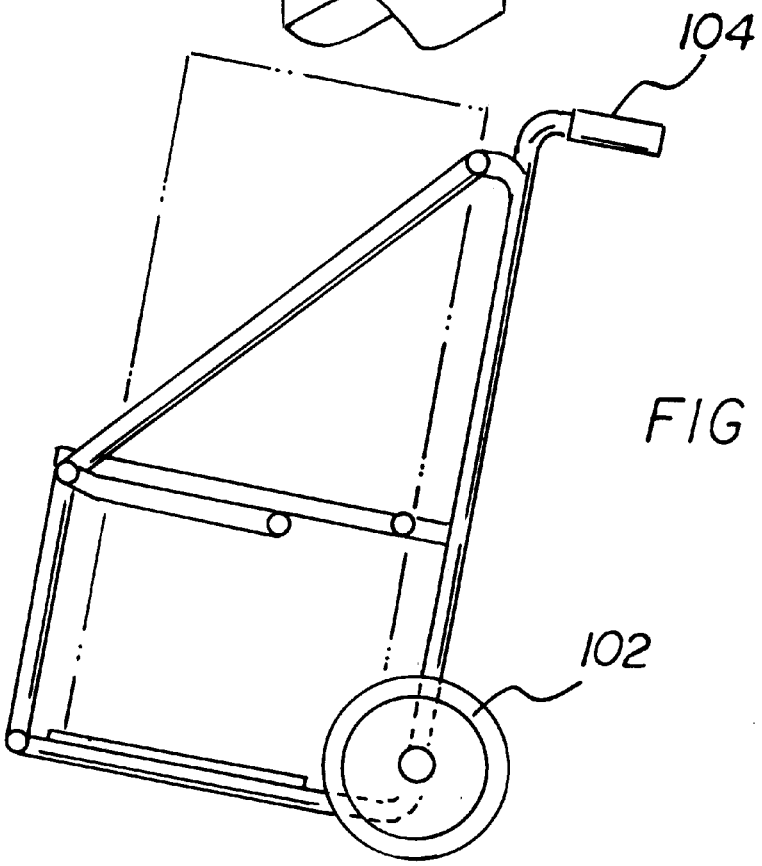
FIG 8

COLLAPSIBLE TOWER

BACKGROUND OF THE INVENTION

1. Field of the Invention

The present invention relates to a collapsible tower and more particularly pertains to effecting the movement of the tower between an expanded operative orientation and a collapsed inoperative orientation.

2. Description of the Prior Art

The use of towers of known designs and configurations is known in the prior art. More specifically, towers of known designs and configurations heretofore devised and utilized for the purpose of expanded and collapsed orientations through known methods and apparatuses are known to consist basically of familiar, expected and obvious structural configurations, notwithstanding the myriad of designs encompassed by the crowded prior art which have been developed for the fulfillment of countless objectives and requirements.

By way of example U.S. Pat. No. 4,086,674 to Chilaradonna discloses a Wind Shield Device. U.S. Pat. No. 4,819,285 to Fetters discloses a Portable Collapsible Baby Crib. U.S. Pat. No. 5,568,933 to Mizuno discloses a Foldable Wheelchair. U.S. Pat. No. 5,645,293 to Cheng discloses a Collapsible Structure for a Stroller.

While these devices fulfill their respective, particular objectives and requirements, the aforementioned patents do not describe a collapsible tower as described herein.

In this respect, the collapsible tower according to the present invention substantially departs from the conventional concepts and designs of the prior art, and in so doing provides an apparatus primarily developed for the purpose of effecting the movement of the tower between an expanded operative orientation and a collapsed inoperative orientation.

Therefore, it can be appreciated that there exists a continuing need for a new and improved collapsible tower which can be used for effecting the movement of the tower between an expanded operative orientation and a collapsed inoperative orientation. In this regard, the present invention substantially fulfills this need.

SUMMARY OF THE INVENTION

In view of the foregoing disadvantages inherent in the known types of towers of known designs and configurations now present in the prior art, the present invention provides an improved collapsible tower. As such, the general purpose of the present invention, which will be described subsequently in greater detail, is to provide a new and improved collapsible tower and method which has all of the advantages of prior art and none of the disadvantages.

To attain this, the present invention essentially comprises a new and improved tower movable between an expanded operative orientation and a collapsed inoperative orientation comprising, in combination a pair of similarly configured side frame assemblies including a left side frame assembly and a right side frame assembly, each side frame assembly including a horizontal lower front tube having a front end and a rear end with a hinge secured at each end. The rear end of the horizontal lower front tube is upwardly turned to have a short vertical extent. A long vertical back tube has an upper end and a lower end with a hinge located at each end. The hinge of the lower end of the long vertical back tube is coincident with the hinge at the rear end of the horizontal lower front tube. The upper end of the long vertical back tube includes a short forwardly extending horizontal extent. A short vertical front tube has an upper end and a lower end with a hinge at each end. The hinge at the lower end of the vertical front tube is coincident with the hinge at the front end of the horizontal lower front tube. A diagonal tube has a lower end and an upper end with a hinge at each end. The hinge at the lower end is coincident with the hinge at the upper end of the short vertical front tube and the hinge at the upper end being coincident with the hinge at the upper end of the long vertical back tube. A long horizontal intermediate tube has a hinge at the front end coincident with the hinge of the upper end of the short vertical front tube and the lower end of the diagonal tube thereby constituting a triple hinge and a hinge spaced forwardly of the rear end of the long horizontal intermediate tube. The rear end of the long horizontal intermediate tube is secured to the intermediate extent of the long vertical back tube. A short horizontal intermediate tube with a hinge at the rear end thereof is coupled to an intermediate extent of the long horizontal intermediate tube. A cross tube couples the left side frame assembly and the right side frame assembly which is located between the triple hinges. Two resilient clips having an upper generally cylindrical section are coupled to each end of the cross tube and a lower section in a generally C-shaped configuration to releasably receive the triple hinge.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collapsible tower which has all of the advantages of the prior art towers of known designs and configurations and none of the disadvantages.

It is another object of the present invention to provide a new and improved collapsible tower which may be easily and efficiently manufactured and marketed.

It is a further object of the present invention to provide a new and improved collapsible tower which is of a durable and reliable construction.

An even further object of the present invention is to provide a new and improved collapsible tower which is susceptible of a low cost of manufacture with regard to both materials and labor, and which accordingly is then susceptible of low prices of sale to the consuming public, thereby making such collapsible tower economically available to the buying public.

Even still another object of the present invention is to provide a collapsible tower for effecting the movement of the tower between an expanded operative orientation and a collapsed inoperative orientation.

Lastly, it is an object of the present invention to provide a collapsible tower including a pair of similarly configured side frame assemblies Each side frame assembly includes a horizontal lower front tube having a front end and a rear end The rear end of the horizontal lower front tube is upwardly turned to have a short vertical extent. A long vertical back tube has an upper end and a lower end with the upper end of the long vertical back tube including a short forwardly extending horizontal extent. A short vertical front tube has an upper end and a lower end. A diagonal tube has a lower end and an upper end. A long horizontal intermediate tube is provided with the rear end of the long horizontal intermediate tube being securely coupled to the intermediate extent of the long vertical back tube. A short horizontal intermediate tube is included. A cross tube couples the side frame assemblies. A plurality of hinges couples the plurality of tubes including a triple hinge located adjacent to the lower end of the diagonal tube. At least one resilient clip is provided to releasably receive the triple hinge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an enlarged front elevational view of the locking means for the tower shown in the prior Figure.

FIG. 8 is a cross-sectional view of the tower utilized as a cart.

The same reference numerals refer to the same parts through the various Figures.

DESCRIPTION OF THE PREFERRED EMBODIMENT

Figure 1:
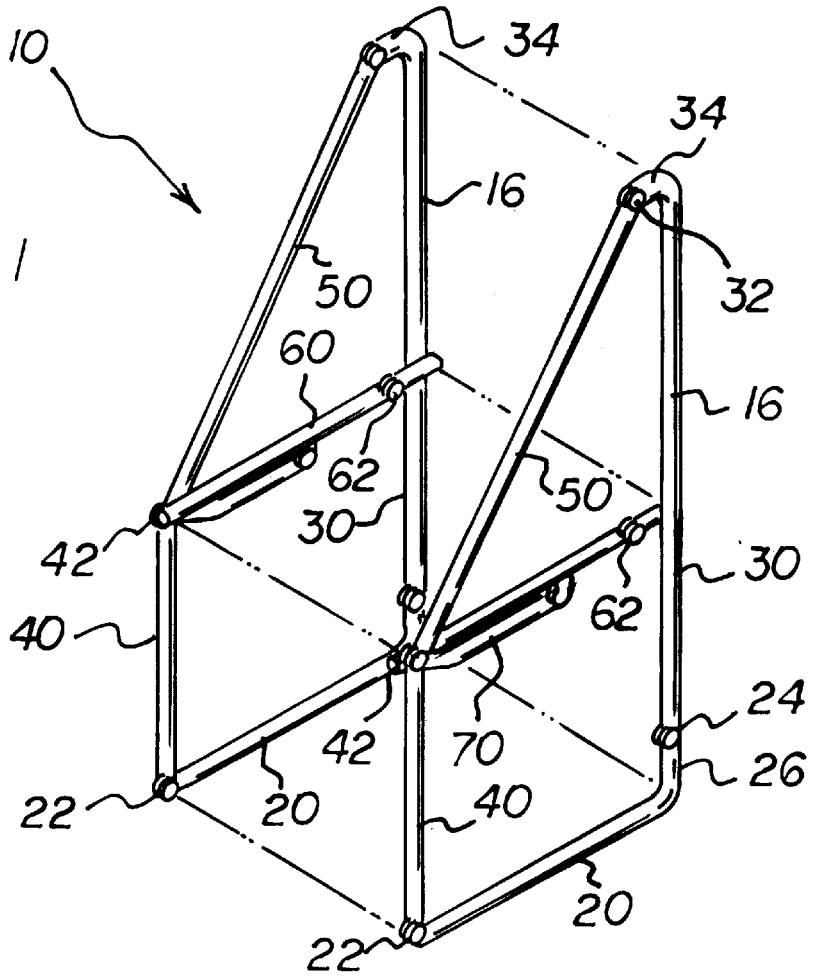
FIG. 1 is a perspective view of the preferred embodiment of the collapsible tower constructed in accordance with the principles of the present invention.
Figure 2:
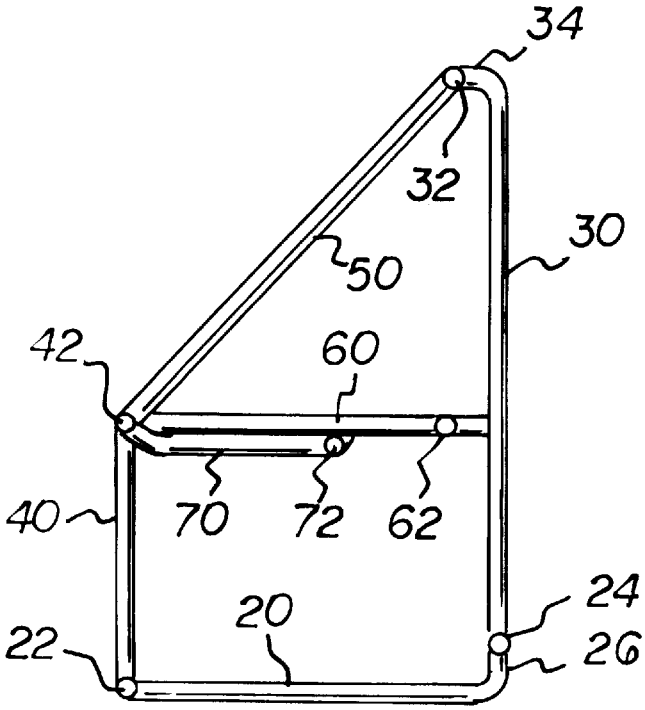
FIG. 2 is a side elevational view of the tower shown in FIG. 1.
Figure 3:
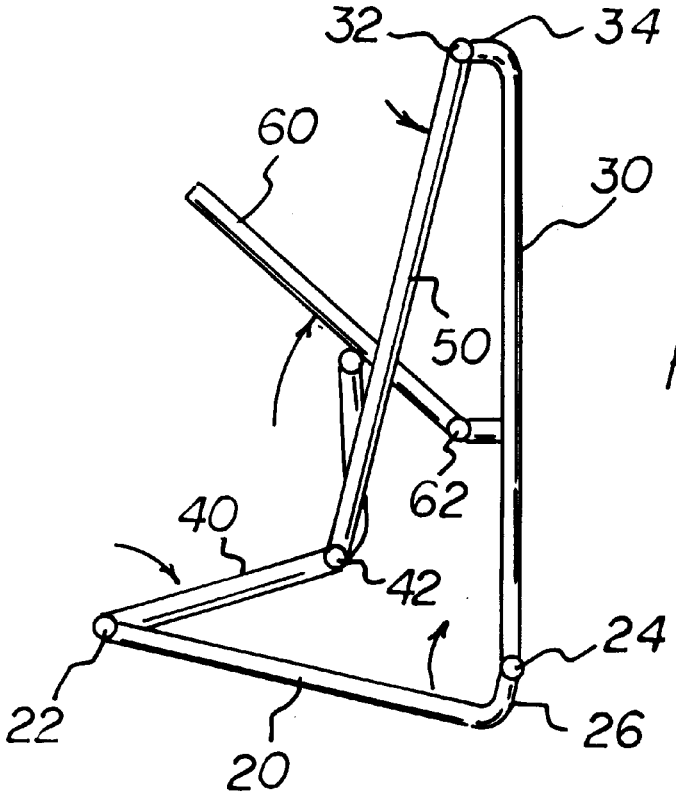
FIG. 3 is a side elevational view similar to FIG. 2 but showing the tower in a partially collapsed orientation.
Figure 4:
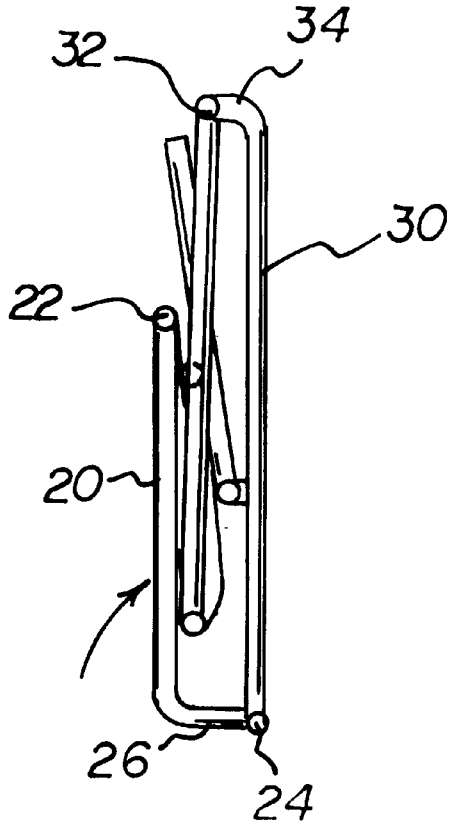
FIG. 4 is a side elevational view similar to FIGS. 2 and 3 but illustrating the tower in a collapsed orientation.

With reference now to the drawings, and in particular to FIG. 1 thereof, the preferred embodiment of the new and improved collapsible tower embodying the principles and concepts of the present invention and generally designated by the reference number 10 will be described.

The present invention, the collapsible tower 10, is comprised of a plurality of components. Such components in their broadest context include a pair of similarly configured side frame assemblies, a horizontal lower front tube, and a long vertical back tube. Such components are individually configured and correlated with respect to each other so as to attain the desired objective.

The present invention essentially comprises a new and improved tower 10 movable between an expanded operative orientation and a collapsed inoperative orientation comprising, in combination, a pair of similarly configured side frame assemblies 14, 16. Such assemblies include a left side frame assembly 14 and a right side frame assembly 16.

Each side frame assembly includes a horizontal lower front tube 20. Each such tube has a front end and a rear end with a hinge 22, 24 secured at each end. The rear end of the horizontal lower front tube is upwardly turned to have a short horizontal extent 26.

A long vertical back tube 30 is provided with an upper end and a lower end. A hinge is located at each end. The hinge of the lower end of the long vertical back tube is coincident with the hinge at the rear end of the horizontal lower front tube. The upper end of the long vertical back tube includes a short forwardly extending horizontal extent 34.

A short vertical front tube 40 is next provided. The tube has an upper end and a lower end. A hinge 42, 22, is at each end. The hinge 22 at the lower end of the vertical front tube is coincident with the hinge at the front end of the horizontal lower front tube.

Next provided is a diagonal tube 50. Each such tube has a lower end and an upper end with a hinge at each end. The hinge 42 at the lower end is coincident with the hinge at the upper end of the short vertical front tube. The hinge 32 at the upper end is coincident with the hinge at the upper end of the long vertical back tube.

Also provided is a long horizontal intermediate tube 60. Each such tube has a hinge 42 at the front end coincident with the hinge of the upper end of the short vertical front tube. The lower end of the diagonal tube thereby constitutes a triple hinge. A hinge 62 is spaced forwardly of the rear end of the long horizontal intermediate tube. The rear end of the long horizontal intermediate tube is secured to the intermediate extent of the long vertical back tube 30.

A short horizontal intermediate tube 70 with a hinge 72 is located at the rear end thereof. Such tube is coupled to an intermediate extent of the long horizontal intermediate tube 60.

For joining the left and right sections is a cross tube 80. Such tube couples the left side frame assembly 14 and the right side frame assembly 16 and is preferably located between the triple hinges.

In order to maintain the tower in an expanded operative orientation, two resilient clips 84 are utilized. Each clip has an upper generally cylindrical section 86. Such sections are permanently coupled to each end of the cross tube 80. A lower section of each clip is formed in a generally C-shaped configuration to releasably receive the triple hinge.

Figure 5:
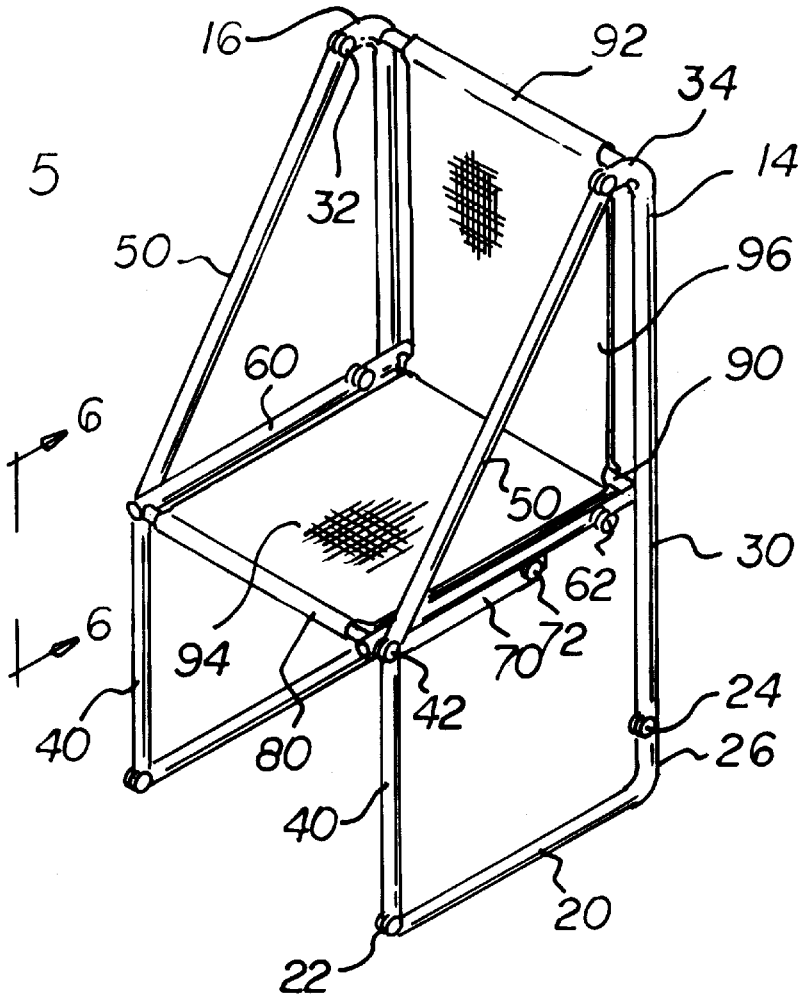
FIG. 5 is a perspective illustration of the tower employed as a chair.
Figure 6:
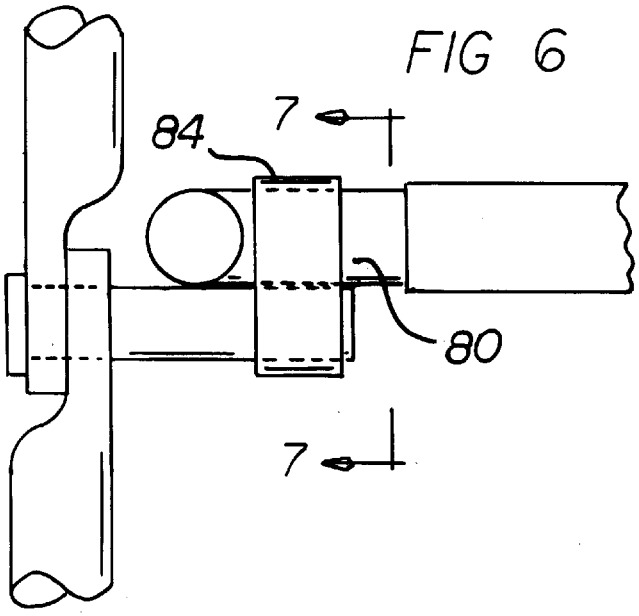
FIG. 6 is a cross-sectional view taken along line 6—6 of FIG. 1.

FIG. 5 illustrates an embodiment of the tower adapted for use as a chair. In such embodiment, additional cross tubes 90, 92 couple the left and right side frames. As such, there are three cross tubes which provide greater stability to the tower. Such tubes include a second cross tube located at an intermediate location between the long vertical back tubes and a third cross tube located between the upper extents of the long vertical back tubes. Two vertical panels 94, 96 couple the tubes and thereby constitute a horizontal seat and a vertical back of a chair which is readily collapsed through the collapsing of the tower.

One final embodiment of the invention is shown in FIG. 8. In such embodiment, the left and right frame assemblies include a second cross tube 100. Such second cross tube couples the lower extents of the long vertical back tubes. In addition, a pair of wheels 102 are rotatably located at the ends of the second tube. In this manner, the tower may function as a cart. The cart may be more readily utilized by the employment of handles 104 extending upwardly and rearwardly from the long vertical back tubes for being held by a user during operation and use. Any number of additional cross tubes may be utilized for supplemental rigidity as may be needed for a particular application.

The tower structure of the present invention has the capability to fold into a compact volume in a well-defined and regular shape for efficient shipping and portable applications.

The tower structure of the present invention is strong and rigid as the two sides are each braced by double triangles.

The tower structure of the present invention provides superior bending moments and torsional rigidity for given structural weight. This is achieved by having the structural members placed at the outside edges of the standing form. The torsional rigidity can be further improved by the addition of thin skins to the non-folding faces of the structure, while the folding faces, namely the sides, are made rigid by the double triangles.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved tower movable between an expanded operative orientation and a collapsed inoperative orientation comprising, in combination:

a pair of similarly configured side frame assemblies including a left side frame assembly and a right side frame assembly, each side frame assembly including;

a horizontal lower front tube having a front end and a rear end with a hinge secured at each end, the rear end of the horizontal lower front tube being upwardly turned to have a short horizontal extent;

a long vertical back tube having an upper end and a lower end with a hinge located at each end, the hinge of the lower end of the long vertical back tube being coincident with the hinge at the rear end of the horizontal lower front tube, the upper end of the long vertical back tube including a short forwardly extending horizontal extent;

a short vertical front tube having an upper end and a lower end with a hinge at each end, the hinge at the lower end of the vertical front tube being coincident with the hinge at the front end of the horizontal lower front tube;

a diagonal tube having a lower end and an upper end with a hinge at each end, the hinge at the lower end being coincident with the hinge at the upper end of the short vertical front tube and the hinge at the upper end being coincident with the hinge at the upper end of the long vertical back tube;

a long horizontal intermediate tube having a hinge at the front end coincident with the hinge of the upper end of the short vertical front tube and the lower end of the diagonal tube thereby constituting a triple hinge and a hinge spaced forwardly of the rear end of the long horizontal intermediate tube, the rear end of the long horizontal intermediate tube being secured to the intermediate extent of the long vertical back tube;

a short horizontal intermediate tube with a hinge at the rear end thereof coupled to an intermediate extent of the long horizontal intermediate tube;

a cross tube coupling the left side frame assembly and the right side frame assembly located between the triple hinges; and two resilient clips having an upper generally cylindrical section coupled to each end of the cross tube and a lower section in a generally C-shaped configuration to releasably receive the triple hinge.

2. A collapsible tower comprising:

a pair of similarly configured side frame assemblies, each side frame assembly including:

a horizontal lower front tube having a front end and a rear end, the rear end of the horizontal lower front tube being upwardly turned to have a short vertical extent;

a long vertical back tube having an upper end and a lower end, the upper end of the long vertical back tube including a short forwardly extending vertical extent;

a short vertical front tube having an upper end and a lower end;

a diagonal tube having a lower end and an upper end;

a long horizontal intermediate tube, the rear end of the long horizontal intermediate tube being securely coupled to the intermediate extent of the long vertical back tube;

a short horizontal intermediate tube;

a cross tube coupling the side frame assemblies;

a plurality of hinges coupling the plurality of tubes including a triple hinge located adjacent to the lower end of the diagonal tube; and at least one resilient clip to releasably receive the triple hinge.

3. The apparatus as set forth in claim 2 and further including a second cross tube located at an intermediate location between the long vertical back tubes and a third cross tube located between the upper extents of the long vertical back tubes with fabric coupling the tubes to constitute a seat and back of a chair.

4. The apparatus as set forth in claim 2 and further including a second cross tube coupling the lower extents of the long vertical back tubes with wheels located at the ends of the second tube whereby the tower may function as a cart.

* * * * *